US007526816B2

(12) United States Patent
Shak

(10) Patent No.: US 7,526,816 B2
(45) Date of Patent: May 5, 2009

(54) BATHROBE HAVING AN ARM ACCESS IN THE FORM OF AN OPENABLE SEAM

(76) Inventor: Beth Shak, 804 Brookwood La., Bryn Mawr, PA (US) 19010

( * ) Notice: Subject to any disclaimer, the term of this patent is extended or adjusted under 35 U.S.C. 154(b) by 0 days.

(21) Appl. No.: 11/031,579

(22) Filed: Jan. 6, 2005

(65) Prior Publication Data

US 2006/0143778 A1 Jul. 6, 2006

(51) Int. Cl.
*A41D 10/00* (2006.01)

(52) U.S. Cl. ..... 2/114

(58) Field of Classification Search ..... 2/113–115, 2/217, 69, 77, 83, 270, 275, 901, 912; 128/877
See application file for complete search history.

(56) References Cited

U.S. PATENT DOCUMENTS

| | | | | | |
|---|---|---|---|---|---|
| 459,106 | A * | 9/1891 | Fifield | 2/114 |
| 1,233,156 | A * | 7/1917 | Zies | 2/114 |
| 1,462,515 | A * | 7/1923 | McElroy | 2/72 |
| 1,489,046 | A * | 4/1924 | Thompson | 2/114 |
| 2,331,051 | A * | 10/1943 | Severance | 2/114 |
| 2,374,643 | A * | 5/1945 | Boettcher | 2/114 |
| 3,353,189 | A * | 11/1967 | Zimmon | 2/114 |
| 4,055,855 | A * | 11/1977 | Ragone et al. | 2/105 |
| 4,422,186 | A * | 12/1983 | Loney | 2/114 |
| 4,570,268 | A * | 2/1986 | Freeman | 2/114 |
| 4,612,673 | A * | 9/1986 | Underhill | 2/114 |
| 4,964,173 | A * | 10/1990 | Gordon et al. | 2/114 |
| 4,995,115 | A * | 2/1991 | Ellis | 2/69 |
| 5,062,159 | A * | 11/1991 | Jakub | 2/114 |
| 5,097,535 | A * | 3/1992 | Dye et al. | 2/69 |
| 5,611,087 | A * | 3/1997 | Adkins | 2/114 |
| 5,621,917 | A * | 4/1997 | Howsden | 2/111 |
| 5,652,962 | A * | 8/1997 | Patnode | 2/114 |
| 5,799,330 | A * | 9/1998 | O'Donoghue-Kitt | 2/114 |
| 6,012,166 | A * | 1/2000 | Burbidge | 2/83 |
| 6,148,444 | A * | 11/2000 | Holmes et al. | 2/69 |
| 6,216,270 | B1 * | 4/2001 | Moquin et al. | 2/69 |
| 6,240,563 | B1 * | 6/2001 | Niedermeyer | 2/114 |
| D457,290 | S * | 5/2002 | Thompson | D2/743 |
| 6,450,168 | B1 * | 9/2002 | Nguyen | 128/869 |
| 6,484,321 | B1 * | 11/2002 | Shamam | 2/114 |
| 6,647,552 | B1 * | 11/2003 | Hogan | 2/114 |
| 6,792,622 | B2 * | 9/2004 | Graves | 2/114 |
| 2003/0126668 | A1 * | 7/2003 | Scroggins | 2/114 |
| 2006/0156450 | A1 * | 7/2006 | McGrath | 2/114 |

* cited by examiner

*Primary Examiner*—Alissa L Hoey
(74) *Attorney, Agent, or Firm*—Hughes Hubbard & Reed LLP; Ronald Abramson

(57) ABSTRACT

A bathrobe that has an arm access in the form of an openable seam such that a user with an IV may put the bathrobe on without the need of substantially moving his or her arm inserted with the IV. The bathrobe comprises a main body having a first shoulder portion, a second, opposing shoulder portion, a collar portion, a first arm opening, and a second, opposing arm opening; a first sleeve that covers the first arm opening and extends downward therefrom, a second sleeve that covers the second arm opening and extends downward therefrom, each of the sleeves having a distal end; and an arm access in the form of an openable seam on one or both sleeves that starts from a starting point on the edge of the collar portion and extends outward on one of the shoulder portions that is closer to the starting point of the seam and downward on the respective sleeve.

13 Claims, 3 Drawing Sheets

BATHROBE HAVING AN ARM ACCESS IN THE FORM OF AN OPENABLE SEAM

BACKGROUND OF THE INVENTION

1. Field of the Invention

The present invention relates to an article of clothing. More particularly, the present invention relates to a bathrobe that has an arm access in the form of an openable seam, which is especially useful in a hospital setting in which patients may be receiving treatment through intravenous (IV) devices.

2. Description of the Prior Art

Regular bathrobes are well known and widely used in places such as homes, hotels, spas and hospitals, and generally speaking they serve the intended purposes well. However, sometimes they present problems for the wearer. For example, it is not uncommon that patients in hospitals and people in nursing homes and other long-term care facilities have IVs (an IV is defined here as including a needle, an adapter, a supporting pad (if necessary) and associated adhesive tapes, but excluding the main tube) inserted into their arms for various medical reasons. Furthermore, it is not uncommon that such persons need to put on a bathrobe before going to the bathroom, making phone calls in the lobby, or going to an examination room. A regular bathrobe will present a problem for such a person because that person has to extend his or her arms, often with large movements, through the arm openings and into the sleeves in order to put on the bathrobe. As should be understood, this process increases the chance that the position of the needle of the IV on that person's arm may be accidentally altered in an undesired or harmful way, or even that the IV device may be dislodged. Furthermore, this process requires that person to use extra efforts due to the stiffness and/or bulkiness of their arm resulting from the IV insertion.

Therefore, there is a need for an improved bathrobe that allows a user with an IV to easily put it on and take it off without the need of substantially moving the arm that is inserted with the IV.

SUMMARY OF THE INVENTION

The present invention discloses a modified bathrobe that has an arm access in the form of an openable seam so that a user with an IV may put the bathrobe on or take it off without the need of substantially moving the arm inserted with the IV. The bathrobe of the present invention comprises a main body having a first shoulder portion, a second, opposing shoulder portion, a collar portion, a first arm opening, and a second, opposing arm opening; a first sleeve that covers the first arm opening and extends downward therefrom, a second sleeve that covers the second arm opening and extends downward therefrom, each of the sleeves having a distal end; and an arm access in the form of an openable seam in one or both sleeves that starts from a starting point on the edge of the collar portion and extends outward on one of the shoulder portions that is closer to the starting point of the seam and downward on the respective sleeve.

Other aspects and advantages of the present invention will become apparent from reading the following detailed description and the accompanying drawings.

DETAILED DESCRIPTION OF THE PREFERRED EMBODIMENTS

Figure 1:
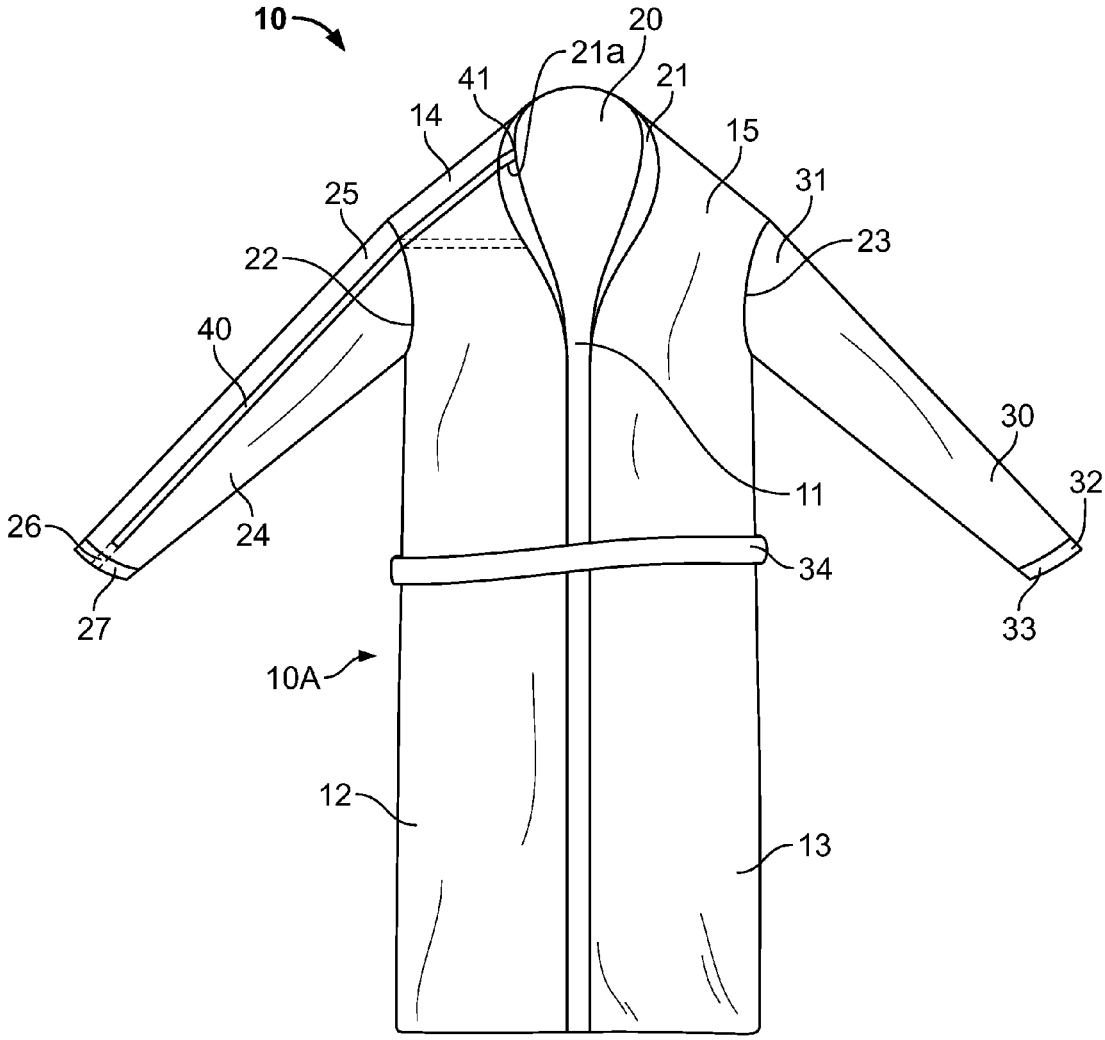
FIG. 1 is a diagrammatic front view of a preferred embodiment of the bathrobe in accordance with the present invention.

Referring now more particularly to FIG. 1 of the accompanying drawings, the preferred embodiment of the bathrobe in accordance with the present invention is generally designated by numeral 10. The bathrobe 10 has a main body 10A that includes a generally rectangular shaped back portion 11, a generally rectangular shaped right front portion 12, a generally rectangular shaped left front portion 13 (note that the "right" side of the garment corresponds to the "left" side of the drawing). Part of the back portion 11 and part of the right front portion 12 form a right shoulder portion 14, and part of the back portion 11 and part of the left front portion 13 form a left shoulder portion 15. As best illustrated in FIG. 1, part of the back portion 11 as well as part of the left and right front portions forms a main front opening 20 of the bathrobe 10.

The main body 10A of the bathrobe 10 further includes a collar portion 21 that is atop the main front opening 20 of the bathrobe 10, a right arm opening 22, and a left arm opening 23.

The bathrobe 10 further has a right sleeve 24, the upper end 25 of which is attached, preferably by sewing, to part of the back portion 11 and part of the right front portion 12 that form the right arm opening 22. As best illustrated in FIG. 1, the right sleeve 24 completely covers the right arm opening 22, and extends outward and downward therefrom. The right sleeve 24 has a distal end 26 at its lower end 27, represented in the preferred embodiment as a cuff.

In a similar fashion, the bathrobe 10 further has a left sleeve 30, the upper end 31 of which is attached, preferably by sewing, to part of the back portion 11 and part of the left front portion 13 that form the left arm opening 23. The left sleeve 30 completely covers the left arm opening 23, and extends outward and downward therefrom. The left sleeve 30 has a distal end 32 at its lower end 33, also represented in the preferred embodiment as a cuff.

In addition, the bathrobe 10 preferably has a belt 34 around its waist area so that a wearer may temporarily and loosely close the main front opening 20.

As best seen in FIG. 1, the bathrobe 10 further has an arm access in the form of an operable seam 40 that starts from a starting point 41 on the edge or rim 21A of the collar portion 21. In FIG. 1, the seam 40 extends outward on the right shoulder portion 14 and downward on the right sleeve 24 until it reaches a point adjacent to the cuff 26 of the right sleeve 24 (FIG. 1 shows the seam 40 on the right sleeve of the bathrobe, but it could of course be on the left sleeve instead, or on both sleeves).

As should be understood, there are some variations to the position of the seam 40. For example, the seam 40 may be on the left shoulder portion 15. Alternatively, the seam 40 may be on one of the front portions. As a general rule, when the seam 40 is on a shoulder portion, it extends outward on one of the shoulder portions that is closer or adjacent to the starting point 41 of the seam 40 and downward on the respective sleeve. Similarly, when the seam 40 is on a front portion, as shown in broken lines in FIG. 1, it extends outward on one of the front portions to point 26B that is closer or adjacent to the starting point of the seam and downward on the respective sleeve. In addition, as best illustrated by broken lines in FIG. 2, the seam 40 may extend downward on the right sleeve 24 until it reaches the edge of the cuff 26. In other words, the seam 40 may or may not run the entire length of the right sleeve 24. In the case where seam 40 does not run the entire length of right sleeve 24, then, as shown in each of FIGS. 2-6, cuff 26 remains as a cylindrically closed cuff portion at said distal end of said sleeve (and similarly for the corresponding structure of the left sleeve of the bathrobe).

Normally there is a top seam between the back portion 11 and each of the right front portion 12 and the left front portion 13. In addition, normally each of the right sleeve 24 and the left sleeve 30 has a side seam, which is usually positioned on the side facing the wearer's body, and is therefore not connected to the top seam. As should be understood, it is possible to co-ordinate those seams to constitute a single, extended seam, and use it as the openable seam 40.

Figure 2:
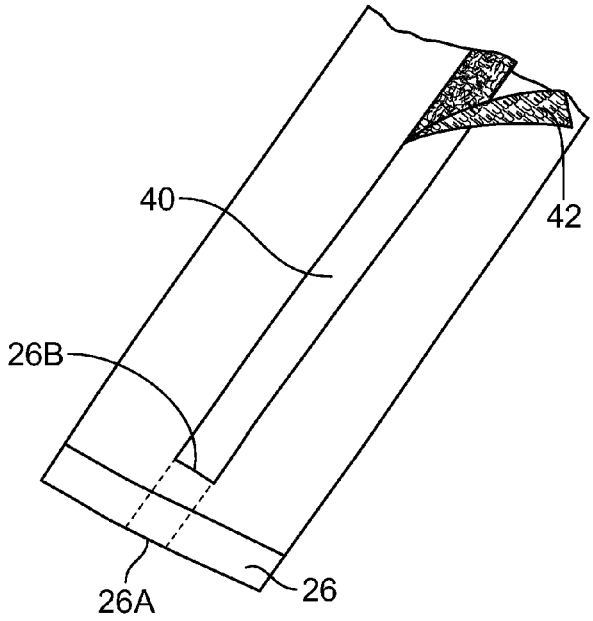
FIG. 2 is an enlarged, partial view of the sleeve of the bathrobe in FIG. 1 that has an arm access in the form of an openable seam; the seam is partially open in FIG. 2.
Figure 3:
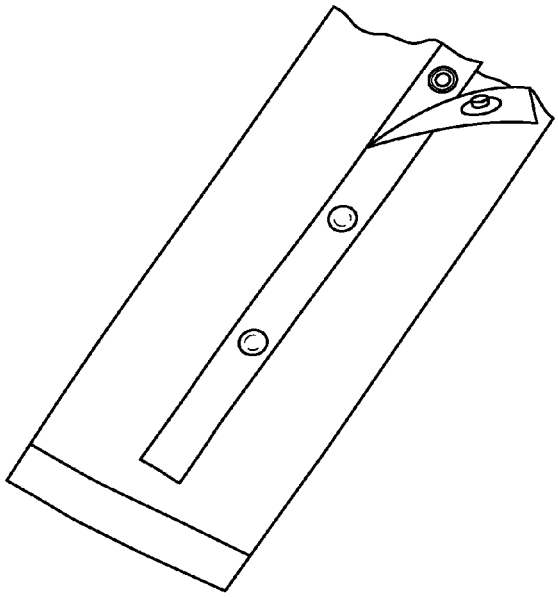
FIGS. 3-6 shows various fasteners that may be used to selectively close the openable seam shown in FIGS. 1-2.
Figure 4:
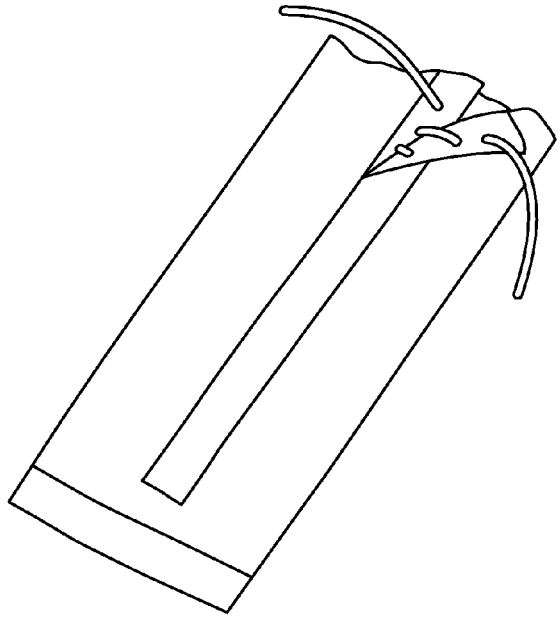
Figure 5:
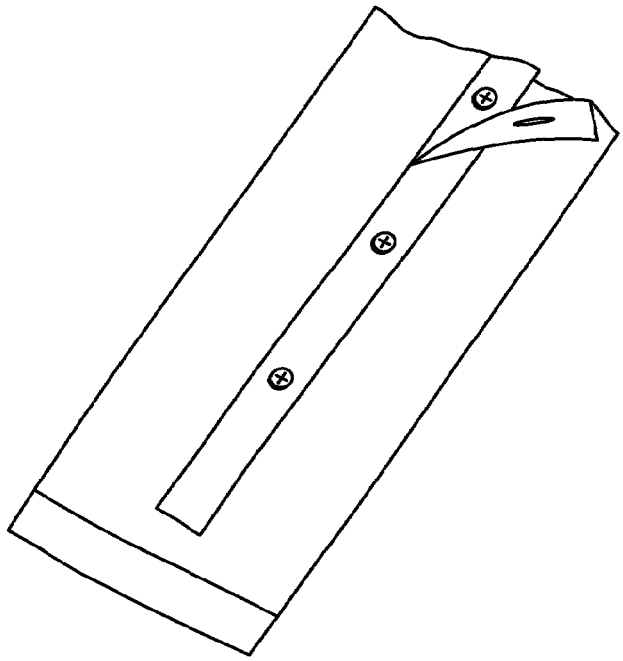
Figure 6:
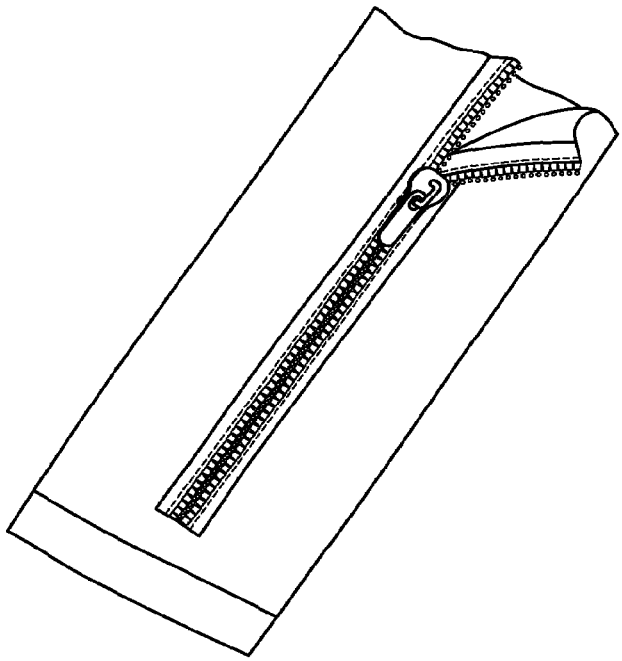

As shown in FIG. 2, the seam 40 is selectively closed by a Velcro® type hook and loop fastener 42. The hook and loop fastener 42 has a length that is substantially equal to the entire length of the seam 40. As should be understood, the hook and loop fastener 42 may be in the form of a number of spaced, shorter pierces that are positioned along the length of the seam 40. Moreover, the seam 40 may be selectively closed by other types of fasteners such as snap fasteners (shown in FIG. 3), strings (FIG. 4), buttons and holes (FIG. 5), zipper (FIG. 6).

The inventor believes that the foregoing description fully enables the various aspects of the invention presented herein. Although the invention has been illustrated and discussed with reference to certain specific embodiments, it should be understood that various modifications, substitutions, variations and changes to the embodiments presented herein are possible without going beyond the scope of the invention, which is defined by the attached claims.

I claim:

1. A bathrobe comprising a main body having a first shoulder portion, a second, opposing shoulder portion, a collar portion, a first arm opening, and a second, opposing arm opening, and a main front opening running from said collar portion to the bottom of said bathrobe whereby said bathrobe may be completely opened from the front, said front opening being closable with a belt; a belt for closing said front opening;

a first sleeve that covers the first arm opening and extends downward therefrom, a second sleeve that covers the second arm opening and extends downward therefrom, each of the sleeves having a distal end;

wherein the bathrobe further comprises an arm access in the form of an openable seam that starts from a starting point on the edge of the collar portion and extends outward on one of the shoulder portions that is closer to the starting point of the seam and downward on the respective sleeve; and wherein the seam extends downward on the sleeve until it reaches a point adjacent to the distal end of the sleeve and does not extend beyond said point, leaving a cylindrically closed, unopenable cuff portion at said distal end of said sleeve.

2. The bathrobe of claim 1, wherein the seam is selectively closed by at least a hook and loop fastener.

3. The bathrobe of claim 1, wherein the seam is selectively closed by a plurality of snap fasteners.

4. The bathrobe of claim 1, wherein the seam is selectively closed by a plurality of strings.

5. The bathrobe of claim 1, wherein the seam is selectively closed by a plurality of buttons and holes.

6. The bathrobe of claim 1, wherein the seam is selectively closed by a zipper.

7. The bathrobe of claim 1, wherein the seam is selectively closed by at least a hook and loop fastener.

8. The bathrobe of claim 1, wherein the seam is selectively closed by a plurality of snap fasteners.

9. The bathrobe of claim 1, wherein the seam is selectively closed by a plurality of strings.

10. The bathrobe of claim 1, wherein the seam is selectively closed by a plurality of buttons and holes.

11. The bathrobe of claim 1, wherein the seam is selectively closed by a zipper.

12. A bathrobe comprising a main body having a first front portion, a second, opposing front portion, a collar portion, a first arm opening, a second, opposing arm opening, and a main front opening running from said collar portion to the bottom of said bathrobe whereby said bathrobe may be completely opened from the front, said front opening being closable with a belt; a belt for closing said front opening;

a first sleeve that covers the first arm opening and extends downward therefrom, a second sleeve that covers the second arm opening and extends downward therefrom, each of the sleeves having a distal end;

wherein the bathrobe further comprises an arm access in the form of an openable seam that starts from a starting point on the edge of the collar portion and extends outward on one of the front portions that is closer to the starting point of the seam and downward on the respective sleeve; and wherein the seam extends downward on the sleeve until it reaches a point adjacent to the distal end of the sleeve and does not extend beyond said point, leaving a cylindrically closed, unopenable cuff portion at said distal end of said sleeve.

13. A bathrobe comprising a main body having a collar portion with a rim, a first arm opening, a second, opposing arm opening, and a main front opening, running from said collar portion to the bottom of said bathrobe whereby said bathrobe may be completely opened from the front, said front opening being closable with a belt; a belt for closing said front opening;

a first sleeve that covers the first arm opening and extends downward therefrom, a second sleeve that covers the second arm opening and extends downward therefrom, each of the sleeves having a distal end;

wherein the bathrobe further comprises an arm access in the form of an openable seam that starts from a starting point on the rim of the collar portion and extends toward one of the sleeves that is closer to the starting point of the seam and downward on the sleeve, and means for selectively closing the seam; and wherein the seam extends downward on the sleeve until it reaches a point adjacent to the distal end of the sleeve and does not extend beyond said point, leaving a cylindrically closed, unopenable cuff portion at said distal end of said sleeve.

* * * * *